US009910407B2

(12) United States Patent
Kakutani et al.

(10) Patent No.: US 9,910,407 B2
(45) Date of Patent: Mar. 6, 2018

(54) IMAGE FORMING APPARATUS AND IMAGE FORMING SYSTEM

(71) Applicant: CANON KABUSHIKI KAISHA, Tokyo (JP)

(72) Inventors: Toshifumi Kakutani, Abiko (JP); Takayuki Iikura, Kashiwa (JP); Shuji Obata, Noda (JP); Mitsuhiro Sugeta, Abiko (JP); Kazunori Miyake, Abiko (JP); Yousuke Hata, Ichikawa (JP); Shinya Suzuki, Toride (JP); Hirohisa Nakajima, Tsukubamirai (JP); Manabu Koseki, Sakuragawa (JP); Takeyuki Suda, Nagareyama (JP); Toshiyuki Abe, Toride (JP); Kazumi Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 14/873,767

(22) Filed: Oct. 2, 2015

(65) Prior Publication Data

US 2017/0096314 A1 Apr. 6, 2017

(30) Foreign Application Priority Data

Oct. 8, 2014 (JP) ..... 2014-207388

(51) Int. Cl.
*G03G 21/20* (2006.01)
*B65H 43/00* (2006.01)
(Continued)

(52) U.S. Cl.
CPC ..... *G03G 21/206* (2013.01); *B65H 29/00* (2013.01); *B65H 37/00* (2013.01); *B65H 43/00* (2013.01); *G03G 15/5004* (2013.01); *B65H 2301/5305* (2013.01); *B65H 2402/10* (2013.01); *B65H 2406/121* (2013.01); *B65H 2515/212* (2013.01); *B65H 2515/40* (2013.01); *B65H 2801/27* (2013.01); *G03G 15/6538* (2013.01); *G03G 2215/0132* (2013.01)

(58) Field of Classification Search
None
See application file for complete search history.

(56) References Cited

U.S. PATENT DOCUMENTS

2002/0025180 A1* 2/2002 Kimizuka ..... G03G 21/206 399/92
2013/0334759 A1* 12/2013 Osaki ..... B65H 29/00 271/3.14

FOREIGN PATENT DOCUMENTS

JP 2002-370862 A 12/2002

* cited by examiner

*Primary Examiner* — Thomas Giampaolo, II
(74) *Attorney, Agent, or Firm* — Fitzpatrick, Cella, Harper & Scinto

(57) ABSTRACT

An image forming apparatus includes an image forming portion; a discharge portion configured to discharge a recording material on which an image is formed by the image forming portion, wherein a delivery conveyance portion having a power source circuit is mountable in a space adjacent to the image forming portion and configured to convey the recording material to a post-processing apparatus; a detection unit configured to detect a temperature; a cooling unit configured to cool the image forming portion; and a control unit configured to control, in a case where the delivery conveyance portion is mounted, rotation of the cooling unit based on the temperature detected by the detection unit in a standby state in which an image forming operation is not performed.

20 Claims, 10 Drawing Sheets

(51) Int. Cl.

| | |
|---|---|
| ***B65H 37/00*** | (2006.01) |
| ***B65H 29/00*** | (2006.01) |
| ***G03G 15/00*** | (2006.01) |

FIG. 4

| USAGE ENVIRONMENT | TYPE OF FAN | WITH SHEET POST-PROCESSING APPARATUS (WITH DELIVERY CONVEYANCE PATH) | | | | WITHOUT SHEET POST-PROCESSING APPARATUS (WITHOUT DELIVERY CONVEYANCE PATH) | | | |
|---|---|---|---|---|---|---|---|---|---|
| | | IN IMAGE FORMATION | | IN STANDBY | | IN IMAGE FORMATION | | IN STANDBY | |
| | | DRIVE VOLTAGE | OPERATION | DRIVE VOLTAGE | OPERATION | DRIVE VOLTAGE | OPERATION | DRIVE VOLTAGE | OPERATION |
| NOT HIGHER THAN 26°C | DELIVERY CONVEYANCE FAN | 24 V | CONTINUOUS OPERATION | – | STOP | – | – | – | – |
| | MAIN BODY FAN 145 | 24 V | CONTINUOUS OPERATION | – | STOP | 24 V | CONTINUOUS OPERATION | – | STOP |
| | MAIN BODY FAN 149 | 24 V | CONTINUOUS OPERATION | – | STOP | 24 V | CONTINUOUS OPERATION | – | STOP |
| 27°C TO 29°C | DELIVERY CONVEYANCE FAN | 24 V | CONTINUOUS OPERATION | – | STOP | – | – | – | – |
| | MAIN BODY FAN 145 | 24 V | CONTINUOUS OPERATION | 12 V | 5 min OPERATION / 60 min STOP / 5 min OPERATION / 60 min STOP | 24 V | CONTINUOUS OPERATION | – | STOP |
| | MAIN BODY FAN 149 | 24 V | CONTINUOUS OPERATION | – | STOP | 24 V | CONTINUOUS OPERATION | – | STOP |
| 30°C TO 32°C | DELIVERY CONVEYANCE FAN | 24 V | CONTINUOUS OPERATION | – | STOP | – | – | – | – |
| | MAIN BODY FAN 145 | 24 V | CONTINUOUS OPERATION | 12 V | CONTINUOUS OPERATION | 24 V | CONTINUOUS OPERATION | – | STOP |
| | MAIN BODY FAN 149 | 24 V | CONTINUOUS OPERATION | – | STOP | 24 V | CONTINUOUS OPERATION | – | STOP |
| 33°C TO 35°C | DELIVERY CONVEYANCE FAN | 24 V | CONTINUOUS OPERATION | 12 V | CONTINUOUS OPERATION | – | – | – | – |
| | MAIN BODY FAN 145 | 24 V | CONTINUOUS OPERATION | 12 V | CONTINUOUS OPERATION | 24 V | CONTINUOUS OPERATION | – | STOP |
| | MAIN BODY FAN 149 | 24 V | CONTINUOUS OPERATION | – | STOP | 24 V | CONTINUOUS OPERATION | – | STOP |
| 36°C TO 37°C | DELIVERY CONVEYANCE FAN | 24 V | CONTINUOUS OPERATION | 12 V | CONTINUOUS OPERATION | – | – | – | – |
| | MAIN BODY FAN 145 | 24 V | CONTINUOUS OPERATION | 12 V | CONTINUOUS OPERATION | 24 V | CONTINUOUS OPERATION | – | STOP |
| | MAIN BODY FAN 149 | 24 V | CONTINUOUS OPERATION | 12 V | CONTINUOUS OPERATION | 24 V | CONTINUOUS OPERATION | – | STOP |
| HIGHER THAN 37°C | DELIVERY CONVEYANCE FAN | 24 V | CONTINUOUS OPERATION | 24 V | CONTINUOUS OPERATION | – | – | – | – |
| | MAIN BODY FAN 145 | 24 V | CONTINUOUS OPERATION | 24 V | CONTINUOUS OPERATION | 24 V | CONTINUOUS OPERATION | – | STOP |
| | MAIN BODY FAN 149 | 24 V | CONTINUOUS OPERATION | 24 V | CONTINUOUS OPERATION | 24 V | CONTINUOUS OPERATION | – | STOP |

IMAGE FORMING APPARATUS AND IMAGE FORMING SYSTEM

BACKGROUND OF THE INVENTION

Field of the Invention

The present invention relates to an image forming apparatus configured to form an image on a recording material, and more particularly, to an image forming apparatus to which a post-processing apparatus is mountable, and to an image forming system.

Description of the Related Art

Hitherto, there is known an image forming apparatus having a configuration including an image forming portion, a document reading portion connected to an upper part of the image forming portion, and a discharge portion provided in a space formed between the image forming portion and the document reading portion. A sheet on which the image formation is completed is discharged to the discharge portion (Japanese Patent Application Laid-Open No. 2002-370862). In a case where a post-processing apparatus for performing post-processing on the sheet is connected to the image forming apparatus described above, a delivery conveyance path is provided between the discharge portion of the image forming apparatus and the post-processing apparatus in some cases. For the purpose of downsizing of an image forming apparatus main body, a power source circuit is mounted to the delivery conveyance path so that electric power is supplied to a motor for the delivery conveyance path from the power source circuit.

In the case where the delivery conveyance path includes the power source circuit, the power source circuit of the delivery conveyance path is located above toner bottles included in the image forming portion. Therefore, there is a fear in that toners in the toner bottles may be affected by heat generated by the power source circuit of the delivery conveyance path. Accordingly, the vicinity of the toner bottles is required to be cooled by a cooling unit such as a fan. On the other hand, when the fan operates while the image forming apparatus is in a sleep state, there is a fear in that operation noise of the fan becomes remarkably audible as compared with that generated during an image formation operation.

SUMMARY OF THE INVENTION

The present invention has been made under conditions described above, and has an object to provide an image forming apparatus configured to cool a periphery of toner bottles to reduce effects of heat on toners while reducing operation noise of a fan.

In order to solve the above-mentioned problems, according to one embodiment of the present invention, there is provided an image forming apparatus comprising:

an image forming portion configured to form an image on a recording material;

a discharge portion configured to discharge the recording material on which the image has been formed by the image forming portion, wherein a delivery conveyance portion is mountable to the discharge portion in a space adjacent to the image forming portion, the delivery conveyance portion being configured to convey the recording material discharged from the discharge portion to a post-processing apparatus configured to perform post-processing on the recording material, the delivery conveyance portion having a power source circuit configured to supply electric power to the delivery conveyance portion;

a detection unit configured to detect a temperature;

a first cooling unit configured to cool the image forming portion; and a control unit configured to control, in a case where the delivery conveyance portion is mounted, rotation and stop of the first cooling unit based on the temperature detected by the detection unit in a second state in which start of an operation of forming the image on the recording material is waited for after a first state in which the image is formed on the recording material by the image forming portion.

Further features of the present invention will become apparent from the following description of exemplary embodiments with reference to the attached drawings.

BRIEF DESCRIPTION OF THE DRAWINGS

FIG. 4 is a table showing control of fans according to the first to third embodiments.

DESCRIPTION OF THE EMBODIMENTS

Modes for carrying out the present invention will be described below in detail based on embodiments with reference to the drawings.

First Embodiment

<Configuration of Image Forming Apparatus>

Figure 1:
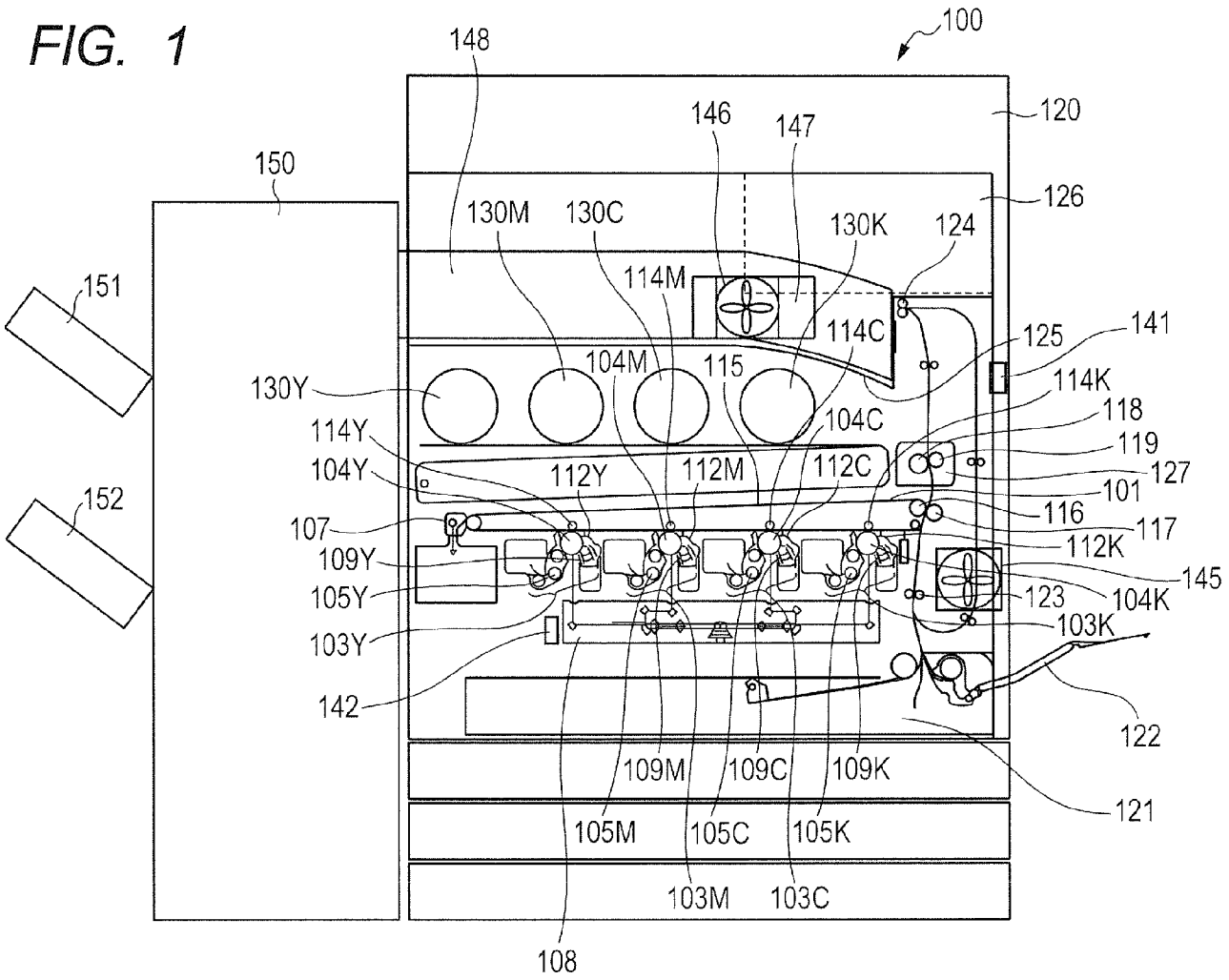
FIG. 1 is a diagram of an image forming apparatus according to first to third embodiments as viewed from a front side.

FIG. 1 is a diagram illustrating a configuration of an image forming apparatus 100 according to a first embodiment. FIG. 1 is a sectional view exemplarily illustrating a basic configuration of the image forming apparatus 100. The image forming apparatus 100 includes an operating portion 126 which is a user interface (UI) configured to allow a user to perform an operation. In this case, the electrophotographic full-color image forming apparatus 100 having the following configuration is exemplified. Specifically, toner containers containing developers (hereinafter referred to as "toners") to be supplied to developing devices are mountable to and removable from the image forming apparatus 100. The image forming apparatus 100 includes, in a mountable and removable manner, process cartridges 103Y, 103M, 103C, and 103K as image forming portions arranged at constant intervals on an approximately horizontal straight line. The process cartridges 103Y, 103M, 103C, and 103K respectively form images of yellow, magenta, cyan, and black. The subscripts Y, M, C, and K for indicating the colors are omitted below unless otherwise deemed necessary.

Drum-type electrophotographic photosensitive members (hereinafter referred to as "photosensitive drums") 104 serving as image bearing members are respectively provided in the process cartridges 103. Around each of the photosensitive drums 104, a primary charger 109, a developing device 105, and a drum cleaner device 112 are arranged. Further, a primary transfer roller 114 is arranged at a position opposed to each photosensitive drum 104 across an intermediate transfer belt 101. Further, an exposure device 108 is provided below portions between the primary chargers 109 and the developing devices 105. Each of the photosensitive drums 104 is rotationally driven by a drive device (not shown) at a predetermined process speed.

The primary chargers 109 serving as charging units charge surfaces of the photosensitive drums 104 uniformly at a predetermined potential having negative polarity by a charging voltage applied from a charging voltage power source (not shown). The developing devices 105 contain the toners (developers) and cause the toners of the respective colors to adhere to electrostatic latent images formed respectively on the photosensitive drums 104 to develop (visualize) the electrostatic latent images as toner images. The primary transfer rollers 114 serving as primary transfer units are arranged on an inner side of an intermediate transfer belt unit 115 so as to be opposed to the photosensitive drums 104 and are arranged so as to be biased toward the photosensitive drums 104, respectively. The drum cleaner devices 112 are cleaning units configured to remove, from the photosensitive drums 104, the toners remaining on the photosensitive drums 104 after the transfer of the toner images formed on the photosensitive drums 104 onto the intermediate transfer belt 101. Each of the drum cleaner devices 112 includes a cleaning blade or the like.

The intermediate transfer belt unit 115 is rotationally driven by a drive roller 116. The drive roller 116 is arranged so as to be opposed to a secondary transfer roller 117 across the intermediate transfer belt 101. Further, a fixing device 127 including a fixing roller 118 and a pressure roller 119 is disposed on a downstream side of the secondary transfer roller 117 in a sheet conveying direction. As illustrated in FIG. 1, in the image forming apparatus 100 of the embodiment, a conveyance path is extended in a vertical direction with respect to an installation surface of the image forming apparatus 100. The sheet is fed to the conveyance path. While the sheet is conveyed along the conveyance path, the toner image is transferred onto the sheet and the transferred unfixed toner image is fixed to the sheet, and then the sheet is discharged from the conveyance path. The above described conveyance path is hereinafter referred to as "a vertical path".

The exposure device 108 is constructed by a laser light-emitting unit which emits light according to time-series electric digital pixel signals of input image information. The exposure device 108 exposes the photosensitive drums 104 with light to form the electrostatic latent images of the respective colors based on the image information on the surfaces of the photosensitive drums 104 charged by the primary chargers 109, respectively. A temperature-outside-apparatus sensor 141 which is a detection unit configured to measure a temperature outside the apparatus is arranged inside the image forming apparatus 100 at a location close to the outside air. A temperature-inside-apparatus sensor 142 which is a detection unit configured to measure a temperature inside the image forming apparatus 100 is arranged at a predetermined position inside the image forming apparatus 100. In the embodiment, the temperature-inside-apparatus sensor 142 is arranged in the vicinity of the exposure device 108. The temperature-inside-apparatus sensor 142 is not necessarily required to be arranged in the vicinity of the exposure device 108 and is arranged, for example, in the vicinity of a target member to be controlled in temperature, such as in the periphery of toner bottles 130 and the periphery of the process cartridges 103. A main body fan 145 which is a first cooling unit is arranged at a position such as in the periphery of the toner bottles 130 so that interior of a main body of the image forming apparatus 100 can be cooled. Further, a main body fan 149 (see FIG. 3) which is a third cooling unit is a fan configured to cool electrical components such as a motor 700 which is a drive unit that will be described later. The main body fan 149 only needs to be arranged at such a position that the electrical components such as the motor 700 can be cooled.

A sheet post-processing apparatus 150 is mounted onto an outer side of the image forming apparatus 100. The image forming apparatus 100 and the sheet post-processing apparatus 150 construct an image forming system. Further, a delivery conveyance path 148 as a delivery conveyance portion is arranged in an in-body region of the image forming apparatus 100. The term "in-body region" of the image forming apparatus 100 means a space between the image forming portion of the image forming apparatus 100 and a document reading apparatus 120 disposed in an upper part of the image forming apparatus 100, which will be described later. The delivery conveyance path 148 is provided so as to convey the sheet, which is discharged from a discharge port provided in the in-body region of the image forming apparatus 100, to the sheet post-processing apparatus 150. Inside the delivery conveyance path 148, an auxiliary power source 147 and a delivery conveyance fan 146 are arranged. The auxiliary power source 147 generates electric power to be supplied to the delivery conveyance path 148 and the sheet post-processing apparatus 150. The delivery conveyance fan 146 is a second cooling unit configured to cool the auxiliary power source 147. In the embodiment, the space in which the delivery conveyance path 148 is arranged is defined by the document reading apparatus 120 and the image forming portion of the image forming apparatus 100. However, the space may be defined by the image forming portion of the image forming apparatus 100 and another action device operable in cooperation with the image forming apparatus 100 so as to form images. The action device is not limited to the document reading apparatus 120.

<Image Formation Operation>

Next, an image formation operation performed by the image forming apparatus 100 will be described. After a document is read by the document reading apparatus 120 as a document reading portion and an image formation start signal used for processing inside a CPU 601 (see FIG. 3) (described later) is output, the image formation operation is started by the image forming apparatus 100. The photosensitive drums 104 of the process cartridges 103, which are rotationally driven at the predetermined process speed, are uniformly charged respectively by the primary chargers 109 to have the negative polarity. Then, the exposure device 108 allows laser light-emitting elements to emit in accordance with color-separated image signals input from an external device to form the electrostatic latent images of the respective colors respectively on the photosensitive drums 104. Then, the toners of the respective colors are caused to adhere to the electrostatic latent images formed on the photosensitive drums 104 by the developing devices 105 to which development voltages having the same polarity as the charging polarity (negative polarity) of the photosensitive drums 104 are applied so that the electrostatic latent images are visualized as the toner images. The toner images are transferred by the photosensitive drums 104 and the primary transfer rollers 114 to which the primary transfer voltage is applied, onto the intermediate transfer belt 101 which is being driven. The primary transfer voltage is a voltage having the polarity opposite to that of the toners, that is, a voltage having positive polarity.

In the manner described above, the toner images of yellow, magenta, cyan, and black are sequentially superimposed on the intermediate transfer belt unit 115. As a result, a full-color toner image is formed on the intermediate transfer belt 101 of the intermediate transfer belt unit 115. The toners remaining on the photosensitive drums 104 are scraped and collected by the cleaner blades respectively provided in the drum cleaner devices 112.

Then, the full-color toner image formed on the intermediate transfer belt 101 is moved to a secondary transfer portion between the drive roller 116 which also serves as an opposed secondary transfer roller and the secondary transfer roller 117. In synchronization with timing at which a leading edge of the full-color toner image on the intermediate transfer belt 101 is moved to the secondary transfer portion, a recording medium such as a sheet fed from a feed cassette 121 or a manual feed tray 122 is conveyed to the secondary transfer portion. More specifically, the fed sheet is conveyed through the conveyance path which is formed approximately vertically (the above-mentioned vertical path) to be conveyed to the secondary transfer portion by registration rollers 123. Onto the sheet conveyed to the secondary transfer portion, the color toner images are collectively transferred to the sheet by the secondary transfer roller 117 to which the secondary transfer voltage having the polarity (positive polarity) opposite to that of the toners is applied. After the color toner images on the intermediate transfer belt 101 are transferred onto the sheet, the toners remaining on the intermediate transfer belt 101 are scraped by a transfer clearing device 107 and collected as a collected toner.

The sheet on which the color toner images are transferred is conveyed to the fixing device 127 located on the downstream side in the sheet conveying direction. The color toner images are heated and pressurized in a fixing nip portion between the fixing roller 118 and the pressure roller 119 so as to be thermally fixed onto a surface of the sheet to form a full-color image on the sheet. Thereafter, the sheet is discharged onto the discharge tray 125 provided in the upper part of the image forming apparatus 100 by discharge rollers 124 as a discharge portion. Then, the image formation operation series is completed. When the sheet post-processing apparatus 150 is mounted to the image forming apparatus 100, the sheet on which the image forming processing is completed is conveyed into the delivery conveyance path 148 by the discharge rollers 124. After the sheet delivered from the delivery conveyance path 148 to the sheet post-processing apparatus 150 is subjected to known post-processing performed by the sheet post-processing apparatus 150, the sheet is discharged to a tray 151 or a tray 152 of the sheet post-processing apparatus 150. Then, the image formation operation series is completed.

<Positional Relationship Between Auxiliary Power Source and Toner Bottles>

Figure 2:
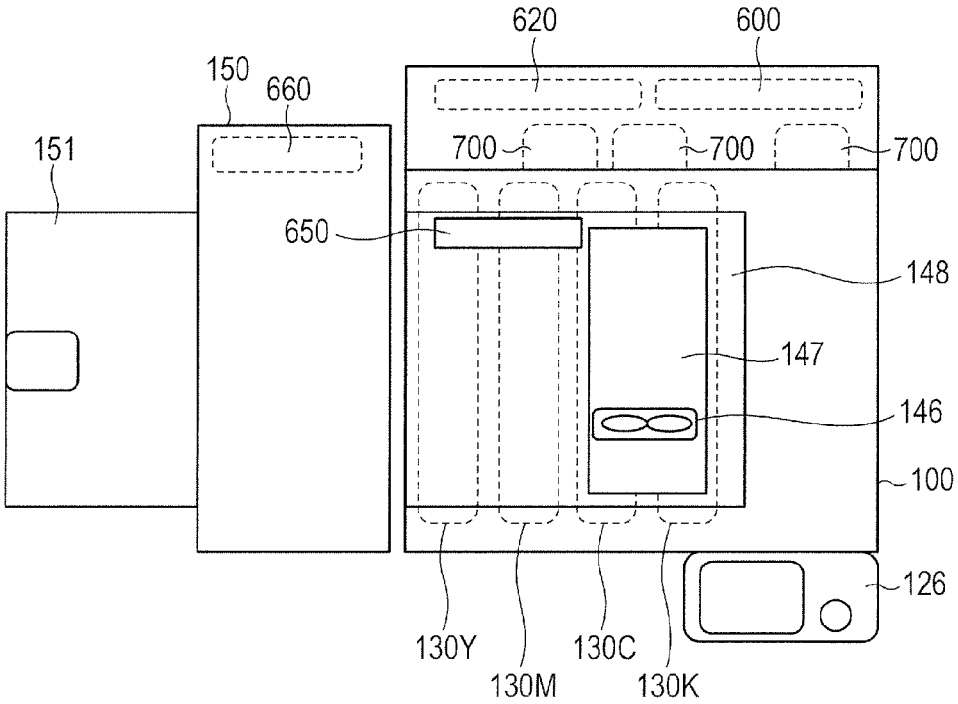
FIG. 2 is a diagram of the image forming apparatus according to the first to third embodiments as viewed from an upper side.

FIG. 2 is a diagram of the image forming apparatus 100 and the sheet post-processing apparatus 150 illustrated in FIG. 1 as viewed from above. FIG. 2 illustrates a state in which the image forming apparatus 100 is viewed from above with the document reading apparatus 120 being removed for ease of visibility. Here, a side on which the operating portion 126 is arranged corresponds to a front surface of the image forming apparatus 100. On a back-surface side of the image forming apparatus 100, a control board 600 for the main body of the image forming apparatus 100, a board for a main power source 620 as a power source portion, and the electrical components such as the motor 700 are arranged. Further, a control board 660 for the sheet post-processing apparatus 150 is arranged on a back-surface side of the sheet post-processing apparatus 150. In the delivery conveyance path 148 arranged in the in-body region of the image forming apparatus 100, a control board 650 is arranged on a back-surface side of the delivery conveyance path 148. In the delivery conveyance path 148, the auxiliary power source 147 is arranged so that a longitudinal direction thereof is oriented in a direction from the front surface to the back surface of the image forming apparatus 100. The delivery conveyance fan 146 configured to cool the auxiliary power source 147 is arranged in the auxiliary power source 147. However, the delivery conveyance fan 146 is not necessarily required to be arranged in the auxiliary power source 147 as long as the delivery conveyance fan 146 is arranged at a position where the delivery conveyance fan 146 can cool the auxiliary power source 147.

In the configuration described above, the toner bottles 130 provided in the main body of the image forming apparatus 100 are arranged under the discharge tray 125 so that a longitudinal direction of the toner bottles 130 is oriented in a direction from the front surface to the back surface of the image forming apparatus 100. Therefore, in particular, the toner bottles 130C and 130K are arranged immediately below the auxiliary power source 147. Because of the positional relationship between the auxiliary power source 147 and the toner bottles 130 as described above, when the auxiliary power source 147 operates to have an increased temperature, the toner bottles 130C and 130K located under the auxiliary power source 147 are susceptible to the effects of the temperature rise of the auxiliary power source 147. Therefore, there is a fear in that the toners in the toner bottles 130C and 130K may be hardened under the effects of the temperature rise of the auxiliary power source 147. Thus, control that will be described later is required.

<Control Blocks>

Figure 3:
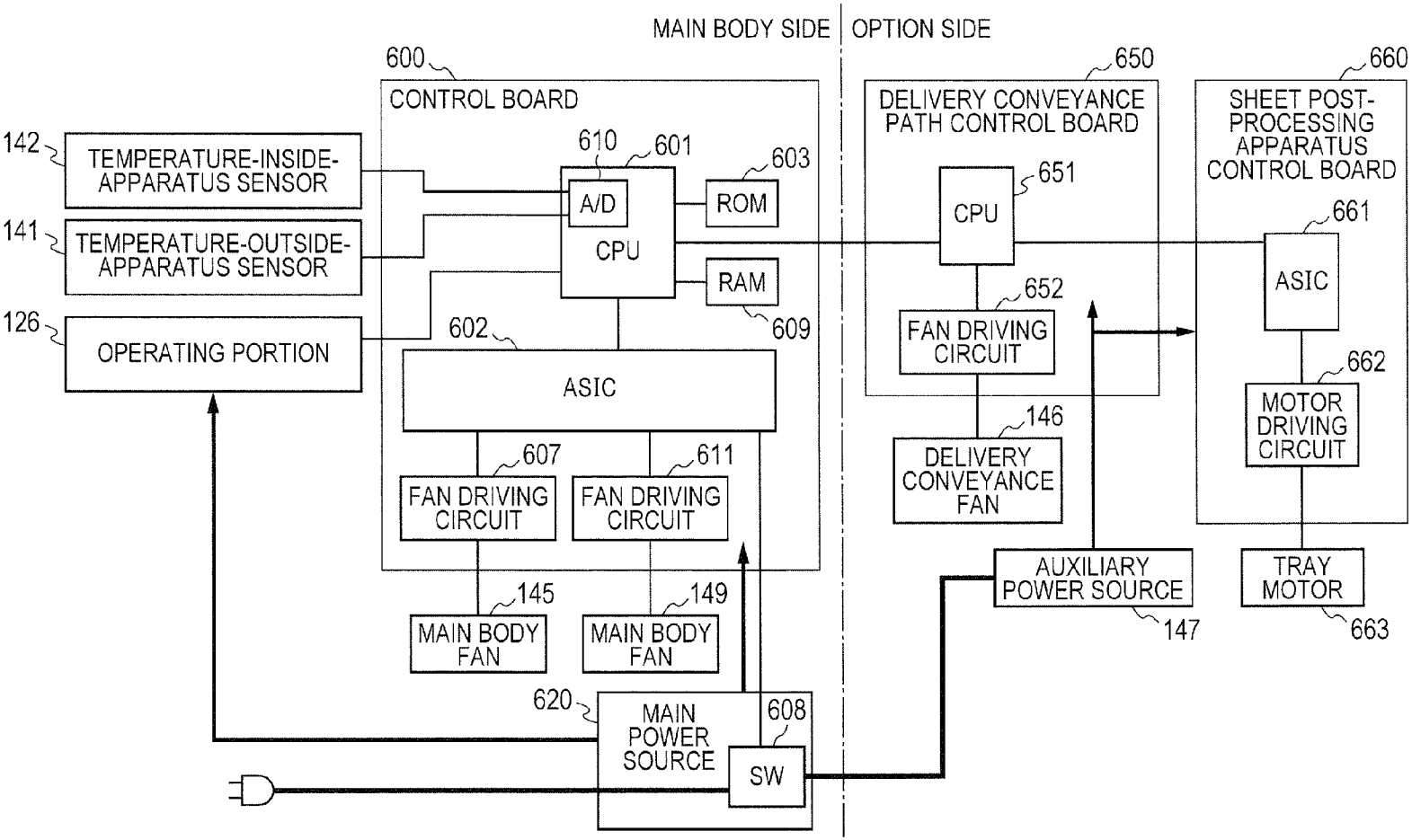
FIG. 3 is a block diagram of the image forming apparatus and a sheet post-processing apparatus according to the first to third embodiments.

FIG. 3 is a diagram of control blocks of the embodiment. In FIG. 3, the main body of the image forming apparatus 100 is located on a left side of the alternate long and short dash line, whereas the delivery conveyance path 148 and the sheet post-processing apparatus 150 are located on a right side (option side). The control board 600 which performs overall control for the image forming apparatus 100 includes a CPU 610 serving as a central processing unit, an ASIC 602, and fan driving circuits 607 and 611. The CPU 601 controls the image forming apparatus 100 based on various programs stored in a ROM 603 while using a RAM 609 as a working area. The CPU 601 also has a timer function. The ASIC 602 is configured by realizing functions relating to drive of the main body fans 145 and 149 and a function of controlling other loads as hardware and reduces computation processing performed by the CPU 601.

Fan control signals are input from the ASIC 602 to the fan driving circuits 607 and 611, which then rotationally drive the main body fans 145 and 149 based on the input fan control signals, respectively. The fan driving circuit 607 can drive the main body fan 145, whereas the fan driving circuit 611 can drive the main body fan 149 at a drive voltage of, for example, a DC voltage 24 V (hereinafter referred to simply as "24 V") or a DC voltage 12 V (hereinafter referred to simply as "12 V"). When the fan driving circuits 607 and 611 respectively drive the main body fans 145 and 149 at 24 V, the main body fans 145 and 149 are rotated at a full speed. On the other hand, when the fan driving circuits 607 and 611 respectively drive the main body fans 145 and 149 at 12 V, the main body fans 145 and 149 are rotated at a half speed. The configuration is such that at least the periphery of the toner bottles 130 can be cooled by driving the main body fan 145. Further, the configuration is such that at least the electrical components such as the motor 700 can be cooled by driving the main body fan 149. As compared with the rotation of the main body fans 145 and 149 at the half speed, the rotation of the main body fans 145 and 149 at the full speed provides a higher effect of cooling the toner bottles 130, the motor 700, and the like.

The temperature-inside-apparatus sensor 142 detects, for example, the temperature in the periphery of the exposure device 108 and outputs a signal based on the detected temperature to an A/D port 610 of the CPU 601. The CPU 601 reads the signal from the temperature-inside-apparatus sensor 142 which is input to the A/D port 610, and feeds back the thus input result of detection by the temperature-inside-apparatus sensor 142 to the control of the main body fans 145 and 149. Further, a signal based on the temperature detected by the temperature-outside-apparatus sensor 141 is also output to the A/D port 610 of the CPU 601. The CPU 601 reads the result of detection by the temperature-outside-apparatus sensor 141 which is input to the A/D port 610. In a case where the A/D port 610 is built in the ASIC 602, similar control can be performed even by reading the result of detection by the temperature-inside-apparatus sensor 142 and/or the temperature-outside-apparatus sensor 141 with the ASIC 602.

The main power source 620 supplies electric power to the control board 600 and the operating portion 126 of the main body of the image forming apparatus 100 (indicated by the thick arrows in FIG. 3). Further, the main power source 620 has a configuration of enabling supply (ON) or interruption (OFF) of the electric power to the auxiliary power source 147 of the delivery conveyance path 148 by a switch (hereinafter referred to as "SW") 608 controlled through the ASIC 602. The CPU 601 turns ON the SW 608 through the ASIC 602 when the auxiliary power source 147 is to be operated and turns OFF the SW 608 through the ASIC 602 when the operation of the auxiliary power source 147 is to be stopped. Alternatively, the CPU 601 may have a configuration of directly controlling the SW 608 without using the ASIC 602. The control board 650 for the delivery conveyance path 148 and the control board 660 for the sheet post-processing apparatus 150 are supplied with the electric power from the auxiliary power source 147. The CPU 601 of the control board 600 for the main body of the image forming apparatus 100 and a CPU 651 of the control board 650 for the delivery conveyance path 148 transmit and receive various information to/from each other through communication. Further, an ASIC 661 of the control board 660 for the sheet post-processing apparatus 150 performs communication with the CPU 651 of the control board 650 for the delivery conveyance path 148 to transmit and receive various information to/from each other.

The delivery conveyance fan 146 configured to cool the auxiliary power source 147 is rotationally driven via a fan driving circuit 652 by the fan control signal output from the CPU 651. The fan driving circuit 652 can drive the delivery conveyance fan 146 by application of, for example, 24 V or 12 V to the delivery conveyance fan 146. When the fan driving circuit 652 drives the delivery conveyance fan 146 at 24 V, the delivery conveyance fan 146 is rotated at the full speed. On the other hand, when the fan driving circuit 652 drives the delivery conveyance fan 146 at 12 V, the delivery conveyance fan 146 is rotated at the half speed. As compared with the rotation at the half speed, the rotation of the delivery conveyance fan 146 at the full speed provides a higher effect of cooling the auxiliary power source 147.

Drive load components such as a tray motor 663 are connected to the sheet post-processing apparatus 150. The tray motor 663 is controlled by the ASIC 661 via a motor driving circuit 662. Although the ASIC 661 performs control in the control board 660 for the sheet post-processing apparatus 150, similar control can be performed even by using a CPU. Further, the CPU 651 may be replaced by an ASIC so that the CPU 601 performs communication control. Even with this configuration, similar control can be performed.

<Fan Control>

Fan control, which is characteristic in the embodiment, will be described with reference to FIG. 4. In a first column of a table of FIG. 4, a temperature of an environment (usage environment) where the image forming apparatus 100 is used, specifically, a temperature (° C.) detected by the temperature-outside-apparatus sensor 141 is indicated. In a second column of the table of FIG. 4, a type of fan included in the image forming system of the embodiment is indicated. In a third column and a fourth column of the table of FIG. 4, a drive voltage (V) and an operating state (such as a continuous operation or stop) in an image forming state (also referred to as "printing state") which is a first state and those in a standby state which is a second state are indicated. The third column of the table of FIG. 4 indicates the drive voltages and the operating states when the sheet post-processing apparatus 150 and the delivery conveyance path 148 are mounted to the image forming apparatus 100 (with the sheet post-processing apparatus 150 and the delivery conveyance path 148), whereas the fourth column of the table of FIG. 4 indicates the drive voltages and the operating states when the sheet post-processing apparatus 150 and the delivery conveyance path 148 are not mounted to the image forming apparatus 100 (without the sheet post-processing apparatus 150 and the delivery conveyance path 148). Here, the standby state means a state in which the start of the image formation operation is waited for, and therefore a state in which the image formation operation is not being executed but the operation can immediately shift to the image formation operation after the CPU 601 receives a job.

When communication with the CPU 651 for the delivery conveyance path 148 is established, the CPU 601 determines that the delivery conveyance path 148 is mounted to the image forming apparatus 100. Further, when communication with the ASIC 661 of the sheet post-processing apparatus 150 is established, the CPU 601 determines that the sheet post-processing apparatus 150 is mounted to the image forming apparatus 100. Further, the term "job" means an instruction and an operation for performing the image formation on one or a plurality of sheets. The CPU 601 may use other means to determine whether or not the delivery conveyance path 148 and the sheet post-processing apparatus 150 are mounted to the image forming apparatus 100.

(With Sheet Post-Processing Apparatus and Delivery Conveyance Path)

First, a case where the sheet post-processing apparatus 150 and the delivery conveyance path 148 are mounted to the image forming apparatus 100 will be described. As shown in FIG. 4, during the image formation operation after entry of the job, all the fans (the delivery conveyance fan 146 and the main body fans 145 and 149) continuously operate at 24 V in all the usage environments. When the drive voltage of the fans is 24 V, the fans are in a state of operating at the full speed. Next, the control of the fans while the image forming apparatus 100 is in the standby state will be described for each temperature outside the apparatus (usage environment).

Case where the Usage Environment is at 26° C. which is a First Temperature or Lower Even when the temperature of the auxiliary power source 147 rises while the image forming apparatus 100 is in the standby state, the temperature in the periphery of the toner bottles 130 does not become equal to or higher than a predetermined temperature (for example, 40° C. or higher). Therefore, all the fans are in a stopped state.

Case where the Usage Environment is at 29° C. which is a Second Temperature or Lower (27° C. to 29° C.)

In order to lower the temperature in the periphery of the toner bottles 130, the main body fan 145 operates for 5 minutes (5 min) at 12 V after the end of the image formation operation. After the operation, the main body fan 145 stops for 60 minutes (60 min). Thereafter, the main body fan 145 repeats the operation at 12 V for 5 minutes and the stop for 60 minutes. The operation of repeating the drive for a short period of time and the stop for a long period of time as described above is hereinafter referred to as "intermittent operation". Here, when the drive voltage of the fan is 12 V, the fan is in a state of operating at the half speed. The delivery conveyance fan 146 and the main body fan 149 are in the stopped state.

Case where the Usage Environment is at 32° C. which is a Fourth Temperature or Lower (30° C. to 32° C.)

After the end of the image formation operation, the main body fan 145 continuously operates at 12 V, that is, at the half speed to cool the periphery of the toner bottles 130. The delivery conveyance fan 146 and the main body fan 149 are in the stopped state.

Case where the Usage Environment is at 35° C. which is a Fifth Temperature or Lower (33° C. to 35° C.)

After the end of the image formation operation, the main body fan 145 continuously operates at 12 V, that is, at the half speed to cool the periphery of the toner bottles 130. Further, the delivery conveyance fan 146 continuously operates at 12 V, that is, at the half speed to cool the auxiliary power source 147. Further, the main body fan 149 is in the stopped state.

Case where the Usage Environment is at 37° C. which is a Third Temperature or Lower (36° C. to 37° C.)

After the end of the image formation operation, the main body fan 145 continuously operates at 12 V, that is, at the half speed to cool the periphery of the toner bottles 130. Further, the delivery conveyance fan 146 also continuously operates at 12 V, that is, at the half speed to cool the auxiliary power source 147. Further, the main body fan 149 is also continuously driven at 12 V, that is, at the half speed to cool the electrical portions such as the motor 700.

Case where the Usage Environment is Higher than 37° C.

After the end of the image formation operation, the main body fan 145 continuously operates at 24 V, that is, at the full speed to cool the periphery of the toner bottles 130. Further, the delivery conveyance fan 146 also continuously operates at 24 V, that is, at the full speed to cool the auxiliary power source 147. Further, the main body fan 149 is also continuously driven at 24 V, that is, at the full speed to cool the electrical portions such as the motor 700.

As described above, in the embodiment, the time period of the drive of the fans is reduced as much as possible, and the fans are driven at the half speed even while the fans are being driven. As a result, operation noise of the motor in the standby state is reduced to suppress a temperature rise. Further, the temperature-outside-apparatus sensor 141 is also used for the purposes other than the control of the fans. The component mounted in advance in the image forming apparatus 100 also serves as the temperature-outside-apparatus sensor 141. By using the sensor mounted in advance in the image forming apparatus 100, the above-mentioned control can be performed without additionally providing a new sensor. Therefore, the control of the fans can be realized without increasing costs.

(Without Sheet Post-Processing Apparatus and Delivery Conveyance Path)

Next, as shown in the table of FIG. 4, the case where the sheet post-processing apparatus 150 and the delivery conveyance path 148 are not mounted (dismounted) will be described. In this case, while the image formation operation is being performed after the entry of the job, the main body fans 145 and 149 continuously operate at 24 V, that is, at the full speed in all the usage environments.

On the other hand, while the image forming apparatus 100 is in the standby state, the operation of the main body fans 145 and 149 is stopped in all the usage environments. In other words, when the delivery conveyance path 148 is not mounted in the case where the state of the image forming apparatus 100 shifts to the standby state, the same control is performed on the main body fans 145 and 149 regardless of the usage environment. This is because a heat source that affects the periphery of the toner bottles 130 is not arranged in the vicinity thereof while the image forming apparatus 100 is in the standby state. As described above, when the sheet post-processing apparatus 150 and the delivery conveyance path 148 are not mounted, all the fans included in the image forming system are stopped while the image forming apparatus 100 is in the standby state. Specifically, the main body fans 145 and 149 except for the delivery conveyance fan 146 included in the delivery conveyance path 148 which is not mounted are stopped, and therefore the operation noise generated by the fans is reduced.

<Control Processing of Fans>

Figure 5:
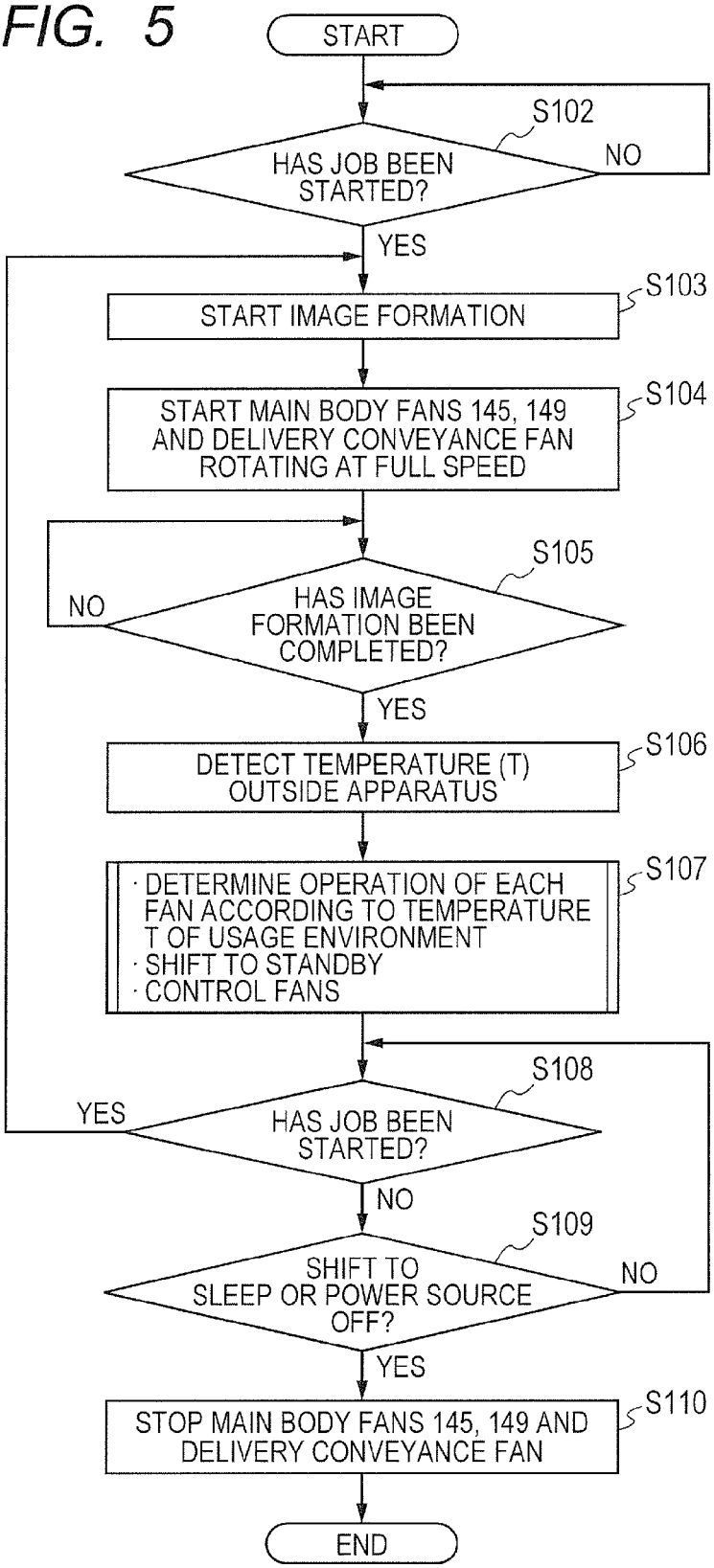
FIG. 5 is a flowchart illustrating a control process of the fans according to the first embodiment.

FIG. 5 is a flowchart illustrating a control of the fans according to the embodiment. FIG. 5 illustrates the control of the fans in the case where the sheet post-processing apparatus 150 and the delivery conveyance path 148 are mounted. When the power source of the main body of the image forming apparatus 100 is turned ON, the CPU 601 starts the following processing. In Step (hereinafter abbreviated as "S") 102, the CPU 601 determines whether or not an instruction to start the job has been received. When the CPU 601 determines in S102 that the instruction to start the job has not been received, the processing in S102 is repeated. On the other hand, when the CPU 601 determines in S102 that the instruction has been received, the processing proceeds to S103. In S103, the CPU 601 starts the image formation operation relating to the job received in S102.

In S104, the CPU 601 rotates the main body fan 145, the main body fan 149, and the delivery conveyance fan 146 at the full speed. More specifically, the CPU 601 drives the main body fans 145 and 149 at 24 V respectively by the fan driving circuits 607 and 611 via the ASIC 602. Further, the CPU 601 drives the delivery conveyance fan 146 at 24 V by the fan driving circuit 652 via the CPU 651. In the following processing, a detailed description of drive of each of the fans is omitted. In S105, the CPU 601 determines whether or not the image formation operation has been completed. When the CPU 601 determines in S105 that the image formation operation has not been completed, the processing in S105 is repeated. On the other hand, when the CPU 601 determines in S105 that the image formation operation has been completed, the processing proceeds to S106. In S106, the CPU 601 detects the temperature outside the apparatus (hereinafter referred to as "temperature T") which is a temperature in the usage environment of the image forming apparatus 100 by the temperature-outside-apparatus sensor 141. In S107, the CPU 601 determines an operation of each of the fans, which is performed after the shift of the state of the image forming apparatus 100 to the standby state based on the temperature T of the usage environment, which is detected by the temperature-outside-apparatus sensor 141, and shifts to the standby state to execute the control of the fans. In S107, the control of the operations of the fans, which is executed by the CPU 601, is performed based on the control of the fans, which is described above referring to the table of FIG. 4. The details of the processing in S107 will be described later referring to a flowchart of FIG. 6.

In S108, the CPU 601 determines whether or not an instruction to start a new job has been received during the execution of the control of each of the fans in the standby state. When the CPU 601 determines in S108 that the instruction to start the new job has been received, the state of the image forming apparatus 100 shifts to the printing state to start the image formation again. Then, the processing returns to S103. On the other hand, when the CPU 601 determines in S108 that the instruction to start the new job has not been received, the processing proceeds to S109. In S109, the CPU 601 determines whether or not an instruction to shift to a sleep state or an instruction to turn OFF the power source (power source OFF) has been received. When it is determined that the instruction has not been received, the processing returns to S108. In this case, the CPU 601 executes the processing in S108 while performing the control of the fans when the image forming apparatus 100 is in the standby state. Here, the sleep state is a state in which power consumption is reduced as compared with that in the printing state and the standby state, for example, by supplying power only to the CPU 601.

When the CPU 601 determines in S109 that the instruction to shift to the sleep state or the power source OFF instruction has been received, the processing proceeds to S110. In S110, the CPU 601 stops all the fans and then ends the processing. More specifically, the CPU 601 stops the main body fans 145 and 149 respectively by the fan driving circuits 607 and 611 via the ASIC 602. Further, the CPU 601 stops the delivery conveyance fan 146 by the fan driving circuit 652 via the CPU 651.

<Operation Determination Processing and Control Processing of Fans>

Figure 6:
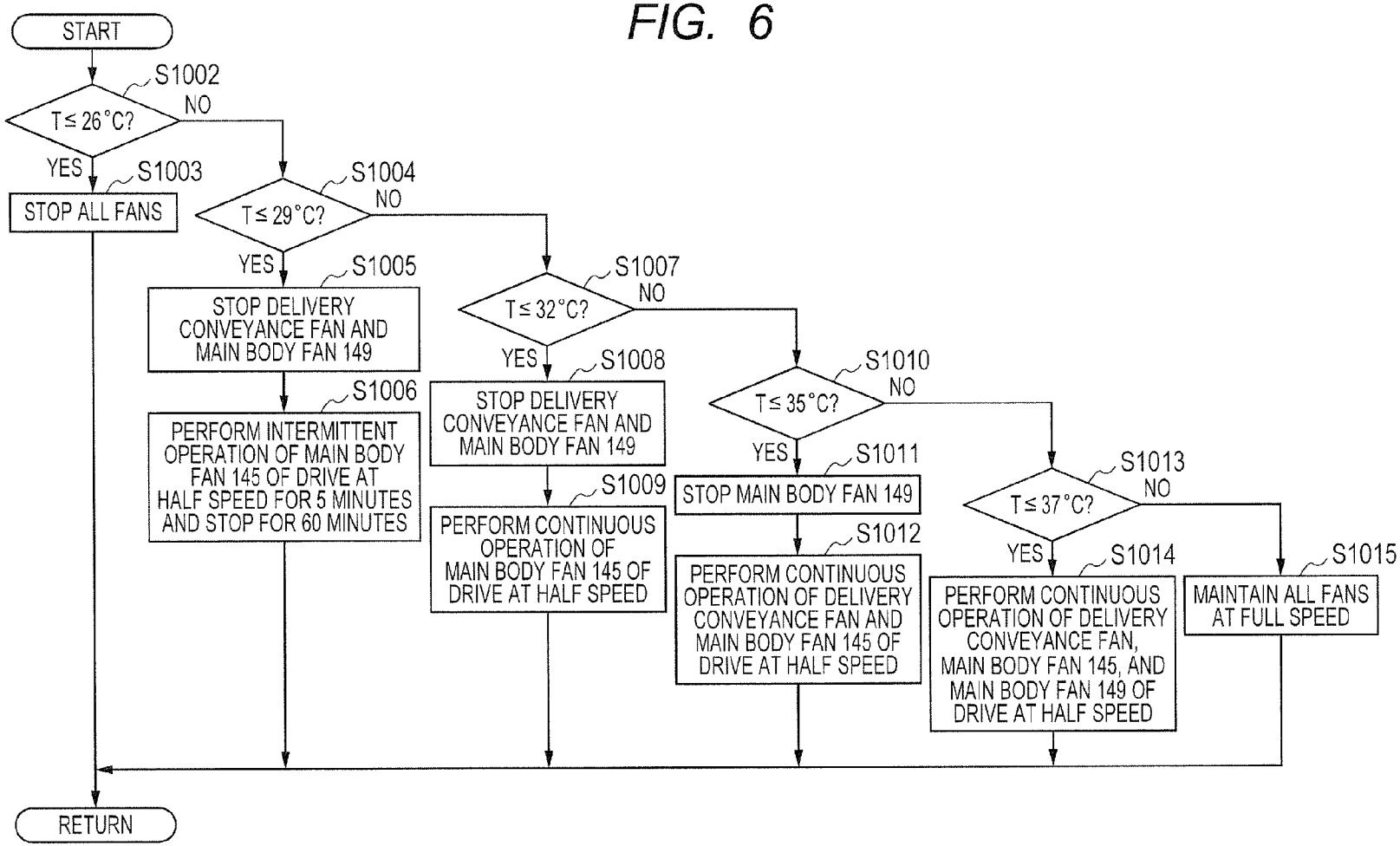
FIG. 6 is a flowchart illustrating a process of determining the control of the fans according to the first embodiment.

FIG. 6 is a flowchart illustrating operation determination processing of the fans and control processing of the fans in S107 of FIG. 5. In S1002, the CPU 601 determines whether or not the temperature detected by the temperature-outside-apparatus sensor 141 in S106 of FIG. 5, that is, the temperature T of the usage environment is equal to or lower than a predetermined temperature, that is, 26° C. or lower. When the CPU 601 determines in S1002 that the temperature T of the usage environment is equal to or lower than 26° C., all the fans are stopped in S1003. More specifically, the CPU 601 stops the main body fans 145 and 149 respectively by the fan driving circuits 607 and 611 via the ASIC 602, and stops the delivery conveyance fan 146 by the fan driving circuit 652 via the CPU 651. In the following processing, a detailed description of the stop of each of the fans is omitted.

When the CPU 601 determines in S1002 that the temperature T of the usage environment is not equal to or lower than 26° C., the CPU 601 then determines in S1004 whether or not the temperature T of the usage environment is equal to or lower than 29° C. When the CPU 601 determines in S1004 that the temperature T of the usage environment is equal to or lower than 29° C., the processing proceeds to S1005. In S1005, the CPU 601 stops the delivery conveyance fan 146 and the main body fan 149. In S1006, the CPU 601 drives the main body fan 145 at the half speed. Further, the CPU 601 controls the fan driving circuit 607 via the ASIC 602 so that the main body fan 145 performs the above-mentioned intermittent operation.

When the CPU 601 determines in S1004 that the temperature T of the usage environment is not equal to or lower than 29° C., the CPU 601 then determines in S1007 whether or not the temperature T of the usage environment is equal to or lower than 32° C. When the CPU 601 determines in S1007 that the temperature T of the usage environment is equal to or lower than 32° C., the CPU 601 stops the delivery conveyance fan 146 and the main body fan 149 in S1008. In S1009, the CPU 601 continuously operates the main body fan 145 at the half speed.

When the CPU 601 determines in S1007 that the temperature T of the usage environment is not equal to or lower than 32° C., the CPU 601 then determines in S1010 whether or not the temperature T of the usage environment is equal to or lower than 35° C. When the CPU 601 determines in S1010 that the temperature T of the usage environment is equal to or lower than 35° C., the CPU 601 stops the main body fan 149 in S1011. In S1012, the CPU 601 drives the delivery conveyance fan 146 and the main body fan 145 at the half speed, and continuously operates the delivery conveyance fan 146 and the main body fan 145.

When the CPU 601 determines in S1010 that the temperature T of the usage environment is not equal to or lower than 35° C., the CPU 601 then determines in S1013 whether or not the temperature T of the usage environment is equal to or lower than 37° C. When the CPU 601 determines in S1013 that the temperature T of the usage environment is equal to or lower than 37° C., the delivery conveyance fan 146, the main body fan 145, and the main body fan 149 are continuously operated at the half speed in S1014. When the CPU 601 determines in S1013 that the temperature T of the usage environment is not equal to or lower than 37° C., all the fans are continuously operated at the full speed in S1015. Specifically, in this case, even after the shift from the printing state to the standby state, all the fans are left continuously operating at the full speed. As described above, a method of controlling the fans is determined based on the temperature T detected by the temperature-outside-apparatus sensor 141 (S1003, S1006, S1009, S1012, S1014, and S1015). Then, the processing performed by the CPU 601 proceeds to the processing in S108 of FIG. 5.

Figure 7A:
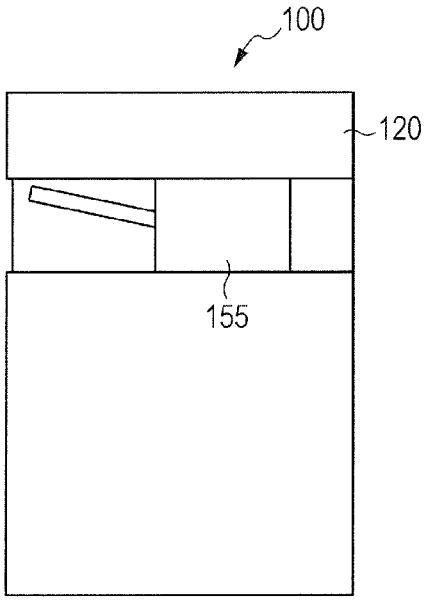
FIG. 7A is a diagram illustrating a sheet post-processing apparatus provided in an in-body region of the image forming apparatus according to the first embodiment.
Figure 7B:
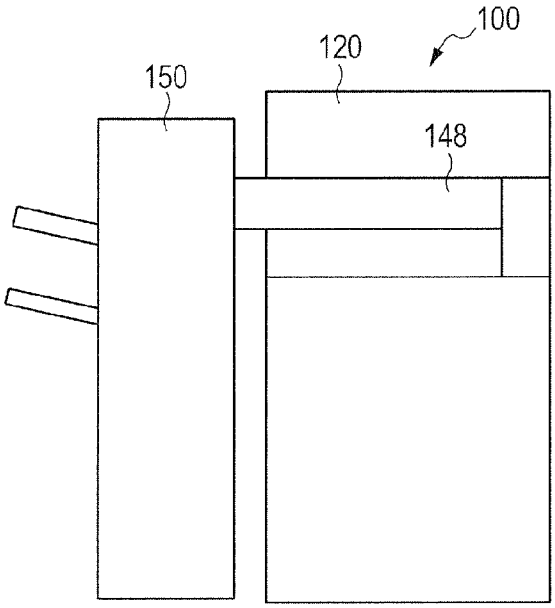
FIG. 7B is a diagram illustrating a sheet post-processing apparatus provided outside the image forming apparatus according to the first embodiment.

The example of the case where the sheet post-processing apparatus 150 and the delivery conveyance path 148 are mounted to the main body of the image forming apparatus 100 has been described above. The control of the main body fan 145 and the main body fan 149 of the image forming apparatus 100 is not necessarily performed only in the case where the sheet post-processing apparatus 150 and the delivery conveyance path 148 are mounted. For example, in a case where a heat source is present above the discharge tray 125 of the image forming apparatus 100, the same control can be used. Here, FIG. 7A and FIG. 7B are diagrams illustrating configuration examples of the image forming system in a simplified manner. For example, the image forming system of the embodiment, as illustrated in FIG. 7B, includes the image forming apparatus 100 to which the delivery conveyance path 148 and the sheet post-processing apparatus 150 are mounted. Even in a case of the image forming system having a configuration illustrated in FIG. 7A, specifically, even in a case where a sheet post-processing apparatus 155 is mounted in the body of the image forming apparatus 100, the above-mentioned control can be applied.

Further, in the embodiment, the control based on the temperature detected by the temperature-outside-apparatus sensor 141 is performed. However, the fans can also be controlled based on the temperature detected by the temperature-inside-apparatus sensor 142. In this case, the temperature of FIG. 4 only needs to be adjusted in consideration of the relationship between the temperature of the usage environment and the temperature inside the image forming apparatus 100 by offsetting a threshold value of each temperature by, for example, 2° C.

Further, the following control is also effective to suppress a temperature rise of the auxiliary power source 147 while the image forming apparatus 100 is in the standby state. Specifically, it is effective to turn OFF electric power that maintains a load state of a drive portion of the sheet post-processing apparatus 150, such as the tray motor 663 configured to vertically move the tray or other power systems. In this case, in order to grasp a status of the sheet post-processing apparatus 150 (for example, opening and closing of a door or an error), electric power for a logic system, which is supplied from the auxiliary power source 147 to the ASIC 661 forming a control portion, is preferably supplied.

Further, although it is described in the example above that the control is performed by the CPU 601 of the image forming apparatus 100, the control may be performed by the CPU 651 for the delivery conveyance path 148. In this case, the result of detection by the temperature-outside-apparatus sensor 141 is output from the CPU 601 to the CPU 651 so that information necessary for the control is transmitted and received between the CPU 601 and the CPU 651.

As described above, according to the embodiment, the periphery of the toner bottles can be cooled to reduce the effects of heat on the toners while the operation noise of the fans is reduced.

Second Embodiment

A second embodiment of the present invention relates to control of the delivery conveyance fan 145 or the main body fan 146 in the image forming apparatus 100 having the same configuration as that of the first embodiment. In this case, the temperature-inside-apparatus sensor 142 is arranged at a position where the temperature-inside-apparatus sensor 142 can follow the temperature in the periphery of the toner bottles 130 with good accuracy. Control described below is executed based on the temperature detected by the temperature-inside-apparatus sensor 142.

<Main Body Fan 145>

Figure 8:
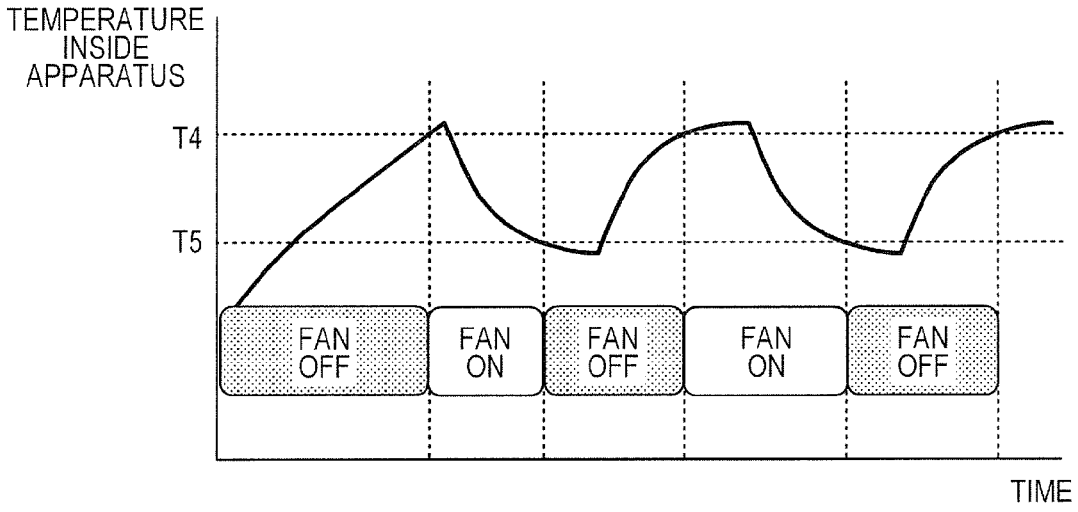
FIG. 8 is an explanatory diagram relating to threshold values of a temperature according to the second embodiment.

FIG. 8 is a graph showing a relationship between an operating state of the main body fan 145 and the temperature while the image forming apparatus 100 is in the standby state after the completion of the image formation operation. The horizontal axis indicates time, whereas the vertical axis indicates a temperature inside the image forming apparatus 100 (hereinafter referred to as "temperature inside the apparatus"). When the temperature inside the apparatus is lower than a predetermined temperature T4 which is a first temperature in a state in which the main body fan 145 is stopped, the main body fan 145 remains stopped (fan OFF). Then, when the temperature inside the apparatus exceeds the predetermined temperature T4 due to a temperature rise, the main body fan 145 rotates (fan ON). At this time, in consideration of the operation noise of the fan, the speed of the main body fan 145 is, for example, the half speed.

At timing at which the temperature inside the apparatus becomes lower than a second temperature which is lower than the predetermined temperature T4, that is, a temperature T5, the main body fan 145 stops. Then, at timing at which the temperature inside the apparatus rises again to become higher than the predetermined temperature T4, the main body fan 145 starts rotating. Specifically, the threshold value T4 of the temperature at which the drive of the main body fan 145 is started and the threshold value T5 of the temperature at which the drive of the main body fan 145 is stopped are different from each other (T4≠T5). Thus, the fan drive control has a hysteresis characteristic. In the embodiment, after the state of the image forming apparatus 100 shifts to the standby state, the control described above is repeated. The predetermined temperature T4 is, for example, 38° C. and the predetermined temperature T5 is, for example, 33° C., and are therefore predetermined values and stored in the ROM 603 in advance. The threshold temperatures for rotating and stopping the fan are changed as described above to perform long-term control. As a result, the fans can be prevented from being unnecessarily repeatedly turned ON and OFF in short periods. In this manner, radiated noise can be suppressed, a lifetime of the fan can be prolonged, and a change in operation noise, which is caused by change in rpm of the fan, can be suppressed.

<Fan Control Processing>

Figure 9:
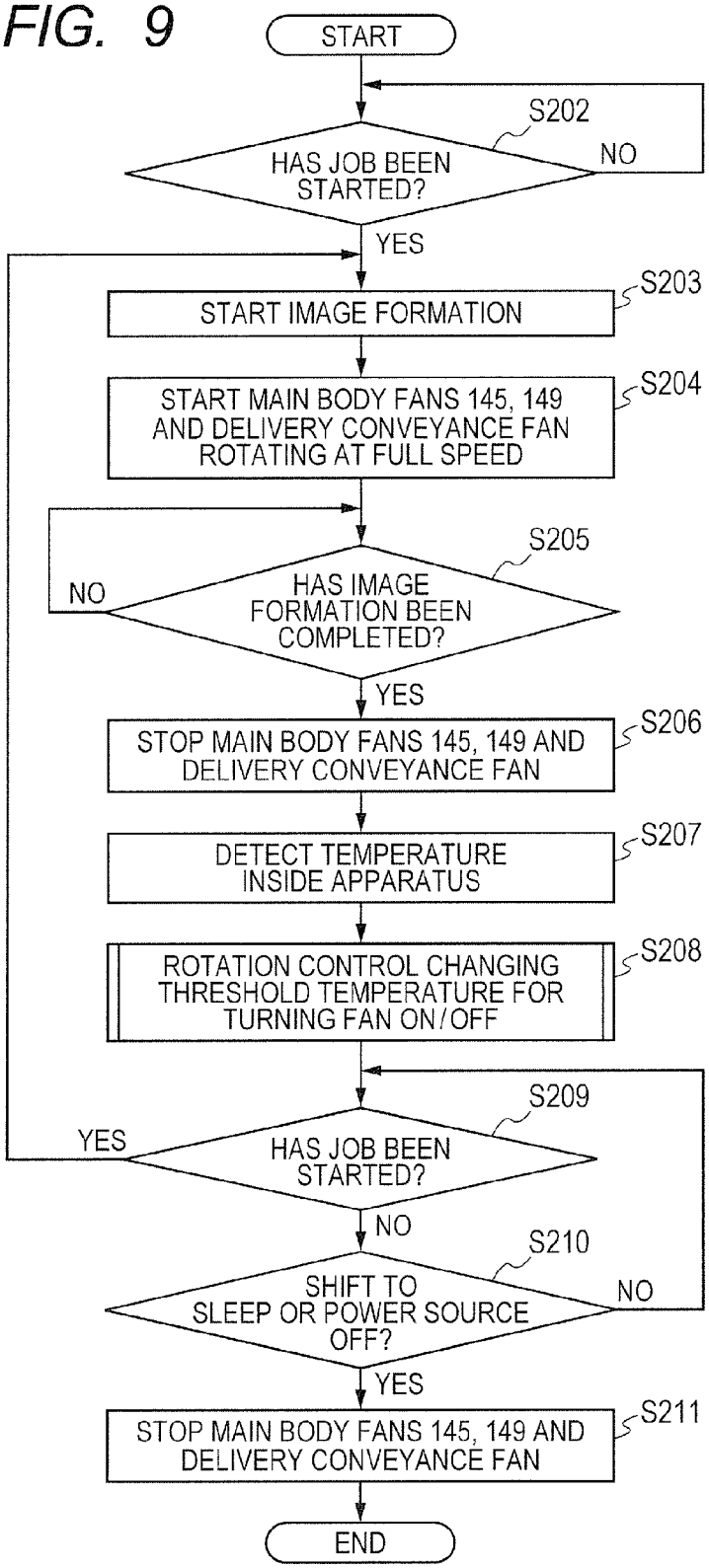
FIG. 9 is a flowchart illustrating a control process of fans according to the second embodiment.

Next, an operation of the above-mentioned control will be described referring to the flowchart of FIG. 9. Processing in S202 to S205 of FIG. 9 is the same as that in S102 to S105 of FIG. 5, and therefore the description thereof is herein omitted. In S206, the CPU 601 stops all the fans. In S207, the CPU 601 detects the temperature inside the apparatus by the temperature-inside-apparatus sensor 142. In S208, the CPU 601 executes the control of each of the fans based on the temperature inside the apparatus detected by the temperature-inside-apparatus sensor 142 in S207 while the image forming apparatus 100 is in the standby state. The processing executed by the CPU 601 in S208 is based on the control with different threshold temperatures for turning ON and OFF the main body fan 145, which is described above referring to FIG. 8. Specifically, when the temperature detected by the temperature-inside-apparatus sensor 142 exceeds the threshold temperature T4 in a state in which the main body fan 145 is stopped, the CPU 601 rotates the main body fan 145 at the half speed. On the other hand, when the temperature detected by the temperature-inside-apparatus sensor 142 becomes lower than the threshold temperature T5 in a state in which the main body fan 145 is rotated, the CPU 601 stops the rotation of the main body fan 145. Processing in S209 to S211 is the same as that in S108 to S110 of FIG. 5, and therefore the description thereof is herein omitted.

Although the control of the main body fan 145 while the image forming apparatus 100 is in the standby state has been described in the embodiment, threshold temperatures for turning ON and OFF the delivery conveyance fan 146 and the main body fan 149 may also be respectively set as needed. With this configuration, a higher cooling effect can be obtained.

As described above, according to the embodiment, the periphery of the toner bottles can be cooled to reduce the effects of heat on the toners while the operation noise of the fans is reduced.

Third Embodiment

Figure 10:
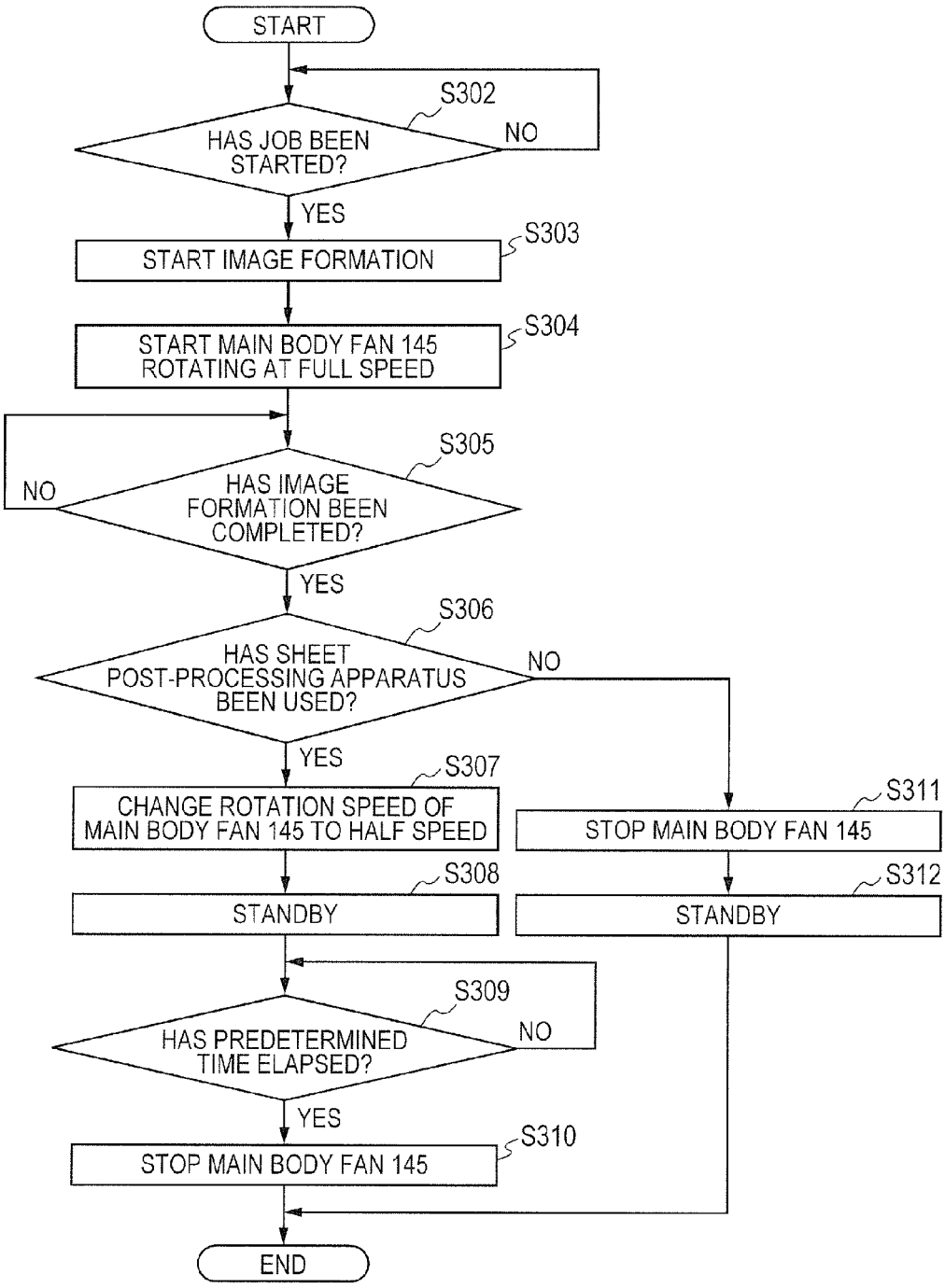
FIG. 10 is a flowchart illustrating a control process of fans according to the third embodiment.

A third embodiment of the present invention relates to control of the main body fan 145 or the delivery conveyance fan 146 in the image forming apparatus 100 having the same configuration as that of the first or second embodiment. Now, the control in the third embodiment will be described referring to FIG. 10.

<Fan Control Processing>

Processing in S302 and S303 is the same as that in S102 and S103 of FIG. 5, and therefore the description thereof is herein omitted. In S304, the CPU 601 rotates the main body fan 145 at the full speed. In the embodiment, the main body fan 149 and the delivery conveyance fan 146 are stopped. However, a configuration in which the main body fan 149 and the delivery conveyance fan 146 are rotated may be used. In S305, the CPU 601 determines whether the image formation operation has been completed.

When the image formation operation has been completed (YES in S305), in S306, the CPU 601 determines whether or not the sheet post-processing apparatus 150 has been used during the execution of the job received in S302. The CPU 601 determines whether or not the sheet post-processing apparatus 150 has been used based on information contained in the job received in S302. The CPU 601 also functions as a detection unit configured to detect whether or not the sheet post-processing apparatus 150 has been used. When the CPU 601 determines in S306 that the sheet post-processing apparatus 150 has been used, the processing proceeds to S307. In this case, the temperature of the delivery conveyance path 148 rises, and therefore there is a fear in that the toner bottles 130 located immediately below the discharge tray 125 may be affected thereby. Therefore, in S307, the main body fan 145 is rotationally driven at the half speed. In S308, the CPU 601 shifts the state of the image forming apparatus 100 to the standby state, and resets and starts a timer. In S309, the CPU 601 determines whether or not predetermined time set in advance has elapsed by referring to the timer. When it is determined that the predetermined time has not elapsed, the processing in S309 is repeated.

When the CPU 601 determines in S309 that the predetermined time has elapsed, the CPU 601 determines that the toner bottles 130 are sufficiently cooled. Thus, in S310, the main body fan 145 is stopped. Then, the processing is ended. The predetermined time in S309 is determined, for example, based on the number of images to be formed, which is specified in the job. For example, the CPU 601 performs control so that a time period for which the main body fan 145 is rotated is shortened as the number of images to be formed, which is specified in the job, becomes smaller and the main body fan 145 is stopped when only a few images are to be formed. The CPU 601 also performs the control so that the time period for which the main body fan 145 is rotated is increased as the number of images to be formed, which is specified in the job, becomes larger. When the CPU 601 determines in S306 that the sheet post-processing apparatus 150 has not been used in the job received in S302, the processing proceeds to S311. In S311, the CPU 601 stops the main body fan 145. In S312, the state of the image forming apparatus 100 shifts to the standby state. Then, the processing is ended.

As described above, in the embodiment, the CPU 601 changes the subsequent fan control while the image forming apparatus 100 is in the standby state depending on whether or not the sheet post-processing apparatus 150 has been used. In this manner, the periphery of the toner bottles 130 included in the image forming apparatus 100 can be efficiently cooled without using the temperature detection sensors (such as the temperature-outside-apparatus sensor 141 and the temperature-inside-apparatus sensor 142).

In the embodiment, the example where the CPU 601 controls the main body fan 145 to rotate at the half speed while the image forming apparatus 100 is in the standby state has been described. However, the following control may be performed if further cooling capability is needed. Specifically, even while the image forming apparatus 100 is in the standby state, the CPU 601 may perform control so that the main body fan 145 is rotated at the full speed, the delivery conveyance fan 146 is driven at the half speed or the full speed, or the main body fan 149 is driven at the half speed or the full speed.

As described above, according to the embodiment, the periphery of the toner bottles can be cooled to reduce the effects of heat on the toners while the operation noise of the fans is reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-207388, filed Oct. 8, 2014, which is hereby incorporated by reference herein in its entirety.

What is claimed is:

1. An image forming apparatus comprising:

an image forming portion configured to form an image on a recording material;

a discharge portion configured to discharge the recording material on which the image has been formed by the image forming portion, wherein a delivery conveyance portion is mountable to the discharge portion in a space adjacent to the image forming portion, the delivery conveyance portion being configured to convey the recording material discharged from the discharge portion to a post-processing apparatus configured to perform post-processing on the recording material, the delivery conveyance portion having a power source circuit configured to supply electric power to the delivery conveyance portion;

a detection unit configured to detect a temperature;

a first cooling unit configured to cool the image forming portion; and a control unit configured to control, in a case where the delivery conveyance portion is mounted, rotation of the first cooling unit based on the temperature detected by the detection unit in a standby state in which an image forming operation is not performed, wherein, in a case where the delivery conveyance portion is not mounted, the control unit performs control on the first cooling unit in the standby state regardless of the temperature detected by the detection unit.

2. An image forming apparatus according to claim 1, wherein the detection unit detects a temperature of an environment outside the image forming apparatus.

3. An image forming apparatus according to claim 1, wherein the detection unit detects a temperature in a vicinity of the image forming portion inside the image forming apparatus.

4. An image forming apparatus according to claim 1, wherein the delivery conveyance portion comprises a second cooling unit configured to cool the power source circuit.

5. An image forming apparatus according to claim 4, wherein, in the case where the delivery conveyance portion is mounted, the control unit stops rotation of the first cooling unit when the temperature detected by the detection unit is equal to or lower than a first temperature in the standby state.

6. An image forming apparatus according to claim 5, further comprising a third cooling unit configured to cool a drive unit configured to drive the image forming portion, wherein, in the case where the delivery conveyance portion is mounted, the control unit stops rotation of the second cooling unit and rotation of the third cooling unit when the temperature detected by the detection unit is equal to or lower than the first temperature in the standby state.

7. An image forming apparatus according to claim 5, wherein, in the case where the delivery conveyance portion is mounted, the control unit repeats an operation of rotating the first cooling unit at a first speed and an operation of stopping the rotation of the first cooling unit when the temperature detected by the detection unit is higher than the first temperature and equal to or lower than a second temperature in the standby state.

8. An image forming apparatus according to claim 7, further comprising a third cooling unit configured to cool a drive unit configured to drive the image forming portion, wherein, in the case where the delivery conveyance portion is mounted, the control unit stops rotation of the second cooling unit and rotation of the third cooling unit when the temperature detected by the detection unit is higher than the first temperature and equal to or lower than the second temperature in the standby state.

9. An image forming apparatus according to claim 7, wherein, in the case where the delivery conveyance portion is mounted, the control unit rotates the first cooling unit at the first speed when the temperature detected by the detection unit is higher than the second temperature and equal to or lower than a third temperature in the standby state.

10. An image forming apparatus according to claim 9, further comprising a third cooling unit configured to cool a drive unit configured to drive the image forming portion, wherein, in the case where the delivery conveyance portion is mounted, the control unit stops rotation of the second cooling unit and rotation of the third cooling unit when the temperature detected by the detection unit is higher than the second temperature and is equal to or lower than a fourth temperature lower than the third temperature in the standby state.

11. An image forming apparatus according to claim 10, wherein, in the case where the delivery conveyance portion is mounted, the control unit rotates the second cooling unit at the first speed and stops the rotation of the third cooling unit when the temperature detected by the detection unit is higher than the fourth temperature and is equal to or lower than a fifth temperature lower than the third temperature in the standby state.

12. An image forming apparatus according to claim 11, wherein, in the case where the delivery conveyance portion is mounted, the control unit rotates the second cooling unit and the third cooling unit at the first speed when the temperature detected by the detection unit is higher than the fifth temperature and equal to or lower than the third temperature in the standby state.

13. An image forming apparatus according to claim 9, further comprising a third cooling unit configured to cool a drive unit configured to drive the image forming portion, wherein, in the case where the delivery conveyance portion is mounted, the control unit rotates the first cooling unit, the second cooling unit, and the third cooling unit at a second speed higher than the first speed when the temperature detected by the detection unit is higher than the third temperature in the standby state.

14. An image forming apparatus according to claim 4, further comprising a third cooling unit configured to cool a drive unit configured to drive the image forming portion, wherein, in the case where the delivery conveyance portion is mounted, the control unit rotates the first cooling unit, the second cooling unit, and the third cooling unit at a second speed higher than the first speed in an image forming state.

15. An image forming apparatus according to claim 1, further comprising a second cooling unit configured to cool a drive unit configured to drive the image forming portion, wherein, in the case where the delivery conveyance portion is not mounted, the control unit stops the rotation of the first cooling unit and rotation of the second cooling unit in the standby state.

16. An image forming apparatus according to claim 1, further comprising a second cooling unit configured to cool a drive unit configured to drive the image forming portion, wherein, in the case where the delivery conveyance portion is not mounted, the control unit rotates the first cooling unit and the second cooling unit at a second speed higher than a first speed in an image forming state.

17. An image forming apparatus according to claim 1, further comprising an action device configured to operate in cooperation with the image forming portion in order to form the image, wherein the delivery conveyance portion is mounted in a space defined by the action device, the image forming portion, and the discharge portion.

18. An image forming apparatus according to claim 17, wherein the action device comprises a reading portion configured to read an image of a document.

19. An image forming apparatus according to claim 1, wherein the post-processing apparatus has a drive portion configured to drive a load for the post-processing, the power source circuit supplies the electric power to the post-processing apparatus, and the control unit stops the electric power supply to the drive portion by the power source circuit in the standby state.

20. An image forming system, comprising:

an image forming apparatus having:

an image forming portion configured to form an image on a recording material; and a discharge portion configured to discharge the recording material on which the image has been formed by the image forming portion;

a post-processing apparatus configured to perform post-processing on the recording material discharged from the discharge portion;

a delivery conveyance portion arranged in a region adjacent to the image forming portion and configured to convey the recording material, which is discharged from the discharge portion, to the post-processing apparatus, the delivery conveyance portion having a power source circuit configured to supply electric power to the delivery conveyance portion;

a detection unit configured to detect a temperature;

a cooling unit configured to cool the image forming portion; and a control unit configured to control, in a case where the delivery conveyance portion is operated, rotation of the cooling unit based on the temperature detected by the detection unit in a standby state in which an image forming operation is not performed, wherein, in a case where the delivery conveyance portion is not operated, the control unit performs control on the cooling unit in the standby state regardless of the temperature detected by the detection unit.

* * * * *